US008758042B2

(12) United States Patent
Conroy

(10) Patent No.: US 8,758,042 B2
(45) Date of Patent: Jun. 24, 2014

(54) DEVICE FOR CONNECTING A CABLE TO AN ELECTRIC COMPONENT ARRANGED IN A HOUSING

(75) Inventor: David Conroy, New York, NY (US)

(73) Assignee: Marlafin AG (CH)

( * ) Notice: Subject to any disclaimer, the term of this patent is extended or adjusted under 35 U.S.C. 154(b) by 36 days.

(21) Appl. No.: 13/577,334

(22) PCT Filed: Feb. 28, 2011

(86) PCT No.: PCT/EP2011/052877

§ 371 (c)(1),
(2), (4) Date: Nov. 20, 2012

(87) PCT Pub. No.: WO2011/107412

PCT Pub. Date: Sep. 9, 2011

(65) Prior Publication Data

US 2013/0059462 A1 Mar. 7, 2013

(30) Foreign Application Priority Data

Mar. 1, 2010 (EP) ..... 10155039

(51) Int. Cl.
*H01R 4/24* (2006.01)

(52) U.S. Cl.
USPC ..... 439/404

(58) Field of Classification Search
CPC ..... H01R 12/67; H01R 4/24; H01R 4/242; H01R 4/2404; H01R 4/2416; H01R 4/2429
See application file for complete search history.

(56) References Cited

U.S. PATENT DOCUMENTS

| | | | | |
|---|---|---|---|---|
| 5,782,652 | A | 7/1998 | Feher et al. | |
| 6,345,902 | B2 * | 2/2002 | Ohkohdo et al. | 362/549 |
| 7,270,563 | B2 * | 9/2007 | Mossner et al. | 439/404 |
| 7,549,891 | B2 * | 6/2009 | Mossner et al. | 439/404 |
| 7,695,307 | B2 * | 4/2010 | Mossner et al. | 439/404 |
| 7,736,173 | B2 * | 6/2010 | Chen | 439/395 |
| 2001/0007526 | A1 * | 7/2001 | Ohkohdo et al. | 362/249 |
| 2003/0171024 | A1 * | 9/2003 | Mossner et al. | 439/404 |
| 2005/0064759 | A1 | 3/2005 | Libby et al. | |

FOREIGN PATENT DOCUMENTS

| | | | |
|---|---|---|---|
| DE | 43 04 385 | A1 | 8/1994 |
| DE | 100 37 749 | A1 | 2/2001 |
| DE | 10 2006 033186 | A1 | 1/2008 |
| EP | 0 929 132 | A2 | 7/1999 |
| WO | WO 2004/105186 | A1 | 12/2004 |

OTHER PUBLICATIONS

International Search Report dated Jun. 1, 2011 issued in corresponding international patent application No. PCT/EP2011/052877.

* cited by examiner

*Primary Examiner* — Chandrika Prasad
(74) *Attorney, Agent, or Firm* — Ostrolenk Faber LLP

(57) ABSTRACT

A device for connecting a cable (17) to an electric component arranged in a housing (18) comprising a support (1) and at least one contact member (2, 3) retained therein. The contact member (2, 3) has a cutting area (6, 7) that cuts through the insulation of the cable (17) and contacts a conductor of the cable. The contact member (2, 3) further has a contact area (4, 5) that contacts a conductor arranged in the housing (18). The support (1) is received in an opening of the housing (18) and the cable (17) is retained between the support and the housing (18). A particular advantage of this solution is that the support which carries the contact members simultaneously fulfills the strain relief function by clamping the cable between itself and the housing.

15 Claims, 1 Drawing Sheet

DEVICE FOR CONNECTING A CABLE TO AN ELECTRIC COMPONENT ARRANGED IN A HOUSING

CROSS REFERENCE TO RELATED APPLICATIONS

The present application is a 35 U.S.C. §371 National Phase conversion of PCT/EP2011/052877, filed Feb. 28, 2011, which claims benefit of European Application No. 10155039.0, filed Mar. 1, 2010, the disclosure of which is incorporated herein by reference.

BACKGROUND OF THE INVENTION

The invention relates to a device for connecting a cable to an electric component that is arranged in a housing, comprising a support and at least one contact member that is retained in the support, the contact member having a cutting area and a contact area, the cutting area cutting through the insulation of the cable and contacting a conductor of the cable, and the contact area contacting a conductor arranged in the housing.

For the present purposes, the term "electric component" is meant to include both electric loads and electric energy sources.

Known in the art are connecting devices for cables where cutting connectors or so-called Insulation Displacement Connectors (IDC) cut through the insulation of the cable during the assembly and thus provide an electric connection to the electric conductor in the cable. An example of such a device is found in reference WO2004/105186A1, see particularly FIG. 3. An advantage of this device is that the electric connection is established very easily and without tools. A disadvantage, however, is that additional measures have to be taken for strain relief.

Further known are cable grips for strain relief, e.g. from reference DE4304385A1. This grip has a retaining part with a plurality of parallel grooves for the respective positively locking insertion of a section of the cable cores, and a holding part for fixing the inserted cable sections in the retaining part. The cable sections are deflected and thus secured against being pulled out of the grip. An advantage of this device is that a secure strain relief is ensured. A disadvantage, however, is that the electric connection of the cable cores has to be established independently from the strain relief and separately.

On the background of this prior art, the invention is based on the object of suggesting a device of the kind mentioned in the introduction that combines the advantages of an easy assembly and of strain relief in a safe manner and is simple and inexpensive to realize.

SUMMARY OF THE INVENTION

This object is attained in that the support is received in an opening of the housing and that the cable is retained between the support and the housing.

A particular advantage of this solution is that the support which carries the contact members simultaneously fulfills the strain relief function by retaining the cable between itself and the housing.

In one embodiment of the invention the cable is deflected near the cutting area. This measure improves contact reliability and the safety against cable pullout.

According to another embodiment, the cable wraps around the support in a U shape such that the cutting area cuts through the cable insulation in the inner apex area of the U, thereby further increasing the contact reliability and the safety against cable pullout.

According to another embodiment, the cable is retained on both sides of the support between the support and the housing, thereby providing a further improved pullout protection.

In another embodiment, the support is inserted into the housing in the direction of its longitudinal axis and locked in the housing by means of detent means. In this manner, the support with the cable is insertable in the housing like a plug.

According to another embodiment, the contact member is approximately Y-shaped with one leg that comprises the cutting area and one leg that comprises the contact area. This allows a simple design of the contact member and its manufacture as a stamped part.

According to another embodiment, the leg comprising the cutting area is shorter than the leg comprising the contact area. As a result, the leg comprising the contact area extends further into the housing and can contact a conductor of the component there.

According to another embodiment, the contact member is embedded in the support such that the two legs project from the contact member. As a result, the contact member is firmly retained and may fulfill its functions optimally.

If according to another embodiment the contact member has anchoring means at the end opposite its legs for anchoring the contact member in the support, the retention of the contact member in the support is further improved. Advantageously, the anchoring means are formed of at least one aperture in the contact member, thereby allowing an easy, simple, and inexpensive manufacture of the contact member and indirectly of the support also.

According to another embodiment, at least two contact members are arranged in the support so that the device is also suitable for cables having two or multiple conductors.

According to another embodiment, the detent means comprise at least one detent cam that is arranged at the free end of at least one spring arm. This allows a particularly simple connection of the support to the housing. Advantageously, two spring arms are provided which are preferably arranged on the support and engage in recesses arranged in the housing. In this manner, the connection between the support and the housing is further improved.

If according to another embodiment the spring arms and/or the detent cams have different widths transversally to the longitudinal axis of the support, the support can only be connected to the housing in a given relative position, thereby reliably preventing a reversed polarity connection of the electric conductors.

Ultimately, according to one embodiment, the support is made of plastics material and preferably produced by injection molding. This manufacturing technique is particularly simple and inexpensive.

BRIEF DESCRIPTION OF THE DRAWINGS

An exemplary embodiment of the invention will be explained in more detail hereinafter with reference to the appended drawings showing FIG. 1 an exploded perspective view of a connecting device and FIG. 2 a sectional view of a detail from FIG. 1.

DESCRIPTION OF PREFERRED EMBODIMENTS

The main element of the device is a support 1 in which according to the example two contact members 2 and 3 are arranged next to each other. The support is preferably produced from plastics material by injection molding and contact members 2, 3 are advantageously molded in during the production process. To improve the anchorage of contact members 2, 3 in the support, contact members 2, 3 may be provided with apertures 13 (FIG. 2) that are filled with plastics material in the molding process.

Figure 1:
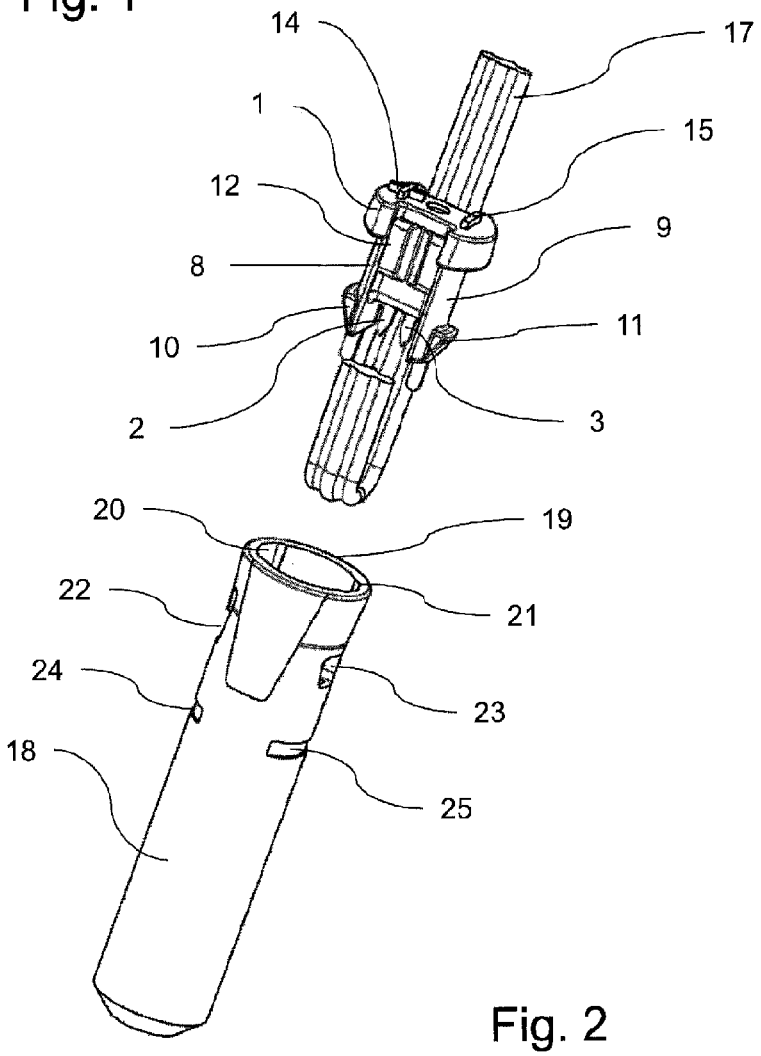
Figure 2:
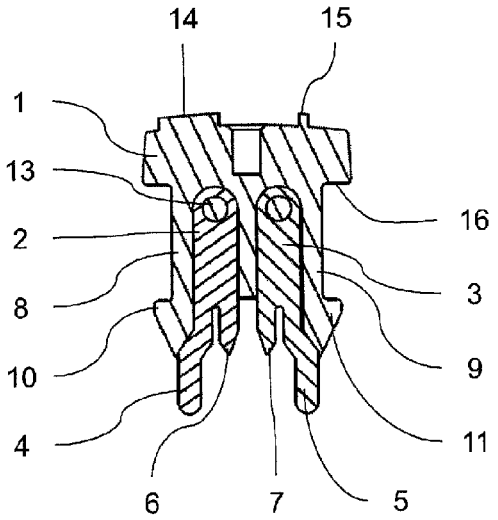

FIG. 2 shows a longitudinal section of support 1 where the arrangement and the construction of contact members 2, 3 is visible particularly clearly. Each contact member 2, 3 is approximately in the shape of an inverted Y. One of the two legs of the Y is shorter and has a point 6, 7 that is intended to cut through the insulation sheath and to contact the cable conductor. The second leg of the Y is longer and forms a contact tab 4, 5 that is intended to contact a conductor of an electric component arranged in a housing 18 (FIG. 1). The component is not depicted, nor is it an object of the present invention. Since contact members 2, 3 are preferably flat portions, as illustrated, they are e.g. very easy to manufacture from sheet or strip material by punching. Furthermore, the dimensions and the arrangement of contact members 2, 3 are chosen such that after cutting through the cable insulation, the respective cable conductor comes to lie between the two legs of the Y. Support 1 further comprises two spring arms 8, 9 whose free ends are provided with respective outwardly projecting detent cams 10 and 11.

The assembly of the device is achieved as follows. A cable 17 which in the example has two conductors is laid around support 1 in a U-shaped arc. Then a traction is preferably applied to both cable ends such that contact points 6 and 7 of contact members 2, 3 cut through the insulation sheath of cable 17 and contact the cable conductors. As a result, the two ends of cable 17 come to lie on either side in respective recesses of contact members 1 intended for this purpose. In these recesses, bearing surfaces 12 for cable 17 are provided. Subsequently, support 1 is inserted along with cable 17 into housing 18. Now, grooves 20 and 21 provided in the inner wall of housing 18 receive detent cams 10, 11 and thus ensure the correct positioning of contact tabs 4, 5 in housing 18. If the correct polarity is furthermore important, groove 20 and detent cam 10 may have a different width than groove 21 and detent cam 11. An alternative possibility of ensuring the correct polarity consists in arranging grooves 20, 21 and accordingly spring arms 8, 9 with detent cams 10, 11 at an angle that is different from 180 degrees. During the insertion of contact member 1 along with cable 17, spring arms 8, 9 are elastically bent toward each other, and when support 1 has been introduced into housing 18 to the point where a shoulder 16 provided on support 1 abuts to the upper edge 19 of housing 18, detent cams 10, 11 that are elastically tensioned by spring arms 8, 9 catch in detent recesses 22, 23 provided in the wall of housing 18 and by their shape prevent that support 1 may be withdrawn from housing 18. In this end position, cable 17 is guided and clamped on opposite sides of support 1 between bearing surfaces 12 and the inner wall of housing 18. The pullout protection can be further increased if bearing surfaces 12 form knobs that deform the cable insulation. If the shorter end of cable 17 protrudes, it may now be cut flush with the upper edge of support 1.

This connection is safe both electrically and mechanically. Due to detent cams 10, 11 the support withstands high tensile forces that are possibly applied to cable 17, and contact points 6, 7 in combination with the U-shaped deflection of cable 17 reliably prevent that cable 17 may be pulled out.

If the correct polarity is to be ensured, support 1 may be provided alternatively or complementarily to the above-mentioned measures with marks 14, 15 that have to be aligned with corresponding marks 24, 25 on housing 18.

- - - - -

LIST OF REFERENCE NUMERALS

1 support
2 contact member
3 contact member
4 contact tab
5 contact tab
6 contact point
7 contact point
8 spring arm
9 spring arm
10 detent cam
11 detent cam
12 bearing surface
13 anchorage element
14 mark
15 mark
16 shoulder
17 cable
18 housing
19 edge
20 groove
21 groove
22 detent recess
23 detent recess
24 mark
25 mark
26
27
28
29

What is claimed is:

1. A device for connecting a cable to an electric component that is arranged in a housing, comprising a support and at least one contact member that is retained in the support, the contact member having a cutting area and a contact area, the cutting area cutting through the insulation of the cable and contacting a conductor of the cable, and the contact area contacting a conductor arranged in the housing, wherein the support is received in an opening of the housing and that the cable is retained between the support and the housing.

2. A device according to claim 1, wherein the cable is deflected near the cutting area.

3. A device according to claim 2, wherein the cable wraps around the support in a U-shape such that the cutting area cuts through the cable insulation in the inner apex area of the U.

4. A device according to claim 3, wherein the cable is retained on both sides of the support between the support and the housing.

5. A device according to claim 1, wherein the support is inserted into the housing in the direction of its longitudinal axis and locked in the housing by means of detent means.

6. A device according to claim 1, wherein the contact member is approximately Y-shaped with one leg that comprises the cutting area and one leg that comprises the contact area.

7. A device according to claim 6, wherein the leg comprising the cutting area is shorter than the leg comprising the contact area.

8. A device according to claim 6, wherein the contact member is embedded in the support such that the two legs project from the contact member.

9. A device according to claim 6, wherein the contact member is provided at its end opposite the legs with anchorage means for anchoring the contact member in the support.

10. A device according to claim 9, wherein the anchoring means consist of at least one aperture in the contact member.

11. A device according to claim 1, wherein at least two contact members are arranged in the support.

12. A device according to claim 5, wherein the detent means include at least one detent cam that is arranged at the free end of at least one spring arm.

13. A device according to claim 12, wherein two spring arms are provided which are preferably arranged on the support and engage in recesses arranged in the housing.

14. A device according to claim 13, wherein the spring arms and/or the detent cams have different widths transversally to the longitudinal axis of the support.

15. A device according to claim 1, wherein the support is made of plastics material and preferably produced by injection molding.

* * * * *